US012405081B1

(12) United States Patent
Goldstein et al.

(10) Patent No.: US 12,405,081 B1
(45) Date of Patent: Sep. 2, 2025

(54) COVERS FOR NON-LETHAL GUN MAGAZINES

(71) Applicants: Avraham Goldstein, Fort Lauderdale, FL (US); William Forrest Crocker, IV, Miramar, FL (US); Mauro Luiz Soares Zamprogno, Jr., Weston, FL (US)

(72) Inventors: Avraham Goldstein, Fort Lauderdale, FL (US); William Forrest Crocker, IV, Miramar, FL (US); Mauro Luiz Soares Zamprogno, Jr., Weston, FL (US)

( * ) Notice: Subject to any disclaimer, the term of this patent is extended or adjusted under 35 U.S.C. 154(b) by 0 days.

(21) Appl. No.: 18/796,395

(22) Filed: Aug. 7, 2024

(51) Int. Cl.
*F41B 11/62* (2013.01)
*F41B 11/55* (2013.01)

(52) U.S. Cl.
CPC ..... *F41B 11/62* (2013.01); *F41B 11/55* (2013.01)

(58) Field of Classification Search
CPC F41B 11/62; F41B 11/55; F41C 33/02; F41C 33/04; F42B 12/72; F16M 13/02
USPC ..... 124/56; 206/315.5, 315.3, 349, 351; 224/197; 42/1.02, 1.01
See application file for complete search history.

(56) References Cited

U.S. PATENT DOCUMENTS 279,242 A * 6/1883 Hazard ..... F41A 9/25 42/6
640,627 A * 1/1900 Burton ..... F41A 19/30 89/194
1,028,032 A * 5/1912 Krag ..... F41A 9/53 89/142
1,456,482 A * 5/1923 Berthier ..... F41A 35/02 89/190
2,052,287 A * 8/1936 End ..... F41A 9/65 89/184
3,119,384 A * 1/1964 Merz ..... F41B 11/62 124/51.1
3,765,114 A * 10/1973 Blake ..... F41A 9/23 42/105
4,116,193 A * 9/1978 Chiba ..... F41B 11/62 124/72
4,164,929 A * 8/1979 Liepins ..... F41A 9/23 124/76
4,884,809 A * 12/1989 Rowan ..... F41B 15/04 42/1.16
4,893,815 A * 1/1990 Rowan ..... F41H 13/0018 42/1.16
7,753,679 B1 * 7/2010 Schuetz ..... F41A 33/00 42/49.02

(Continued)

*Primary Examiner* — Michael D David

(57) ABSTRACT

A cover for a non-lethal gun magazine is disclosed. The cover includes an external shell that has a top side, a bottom side, a wall that connects the top side and the bottom side, and an inner chamber. The cover includes a first opening located on the top side of the external shell, which is configured to receive a non-lethal gun magazine and the inner chamber is configured to fittingly hold the non-lethal gun magazine. The cover further includes a recessed area within the inner chamber that is configured to receive and hold a compressed gas cartridge. In addition, the cover includes a second opening within the wall that connects the top side and the bottom side, which is contiguous with the recessed area and is configured to enable manual contact with the compressed gas cartridge (when such compressed gas cartridge is held within the recessed area).

13 Claims, 8 Drawing Sheets

(56) References Cited

U.S. PATENT DOCUMENTS

| | | | | |
|---|---|---|---|---|
| 10,247,509 | B1 * | 4/2019 | Sumners | F41B 11/80 |
| 11,768,045 | B2 * | 9/2023 | Makarov | F41A 15/20 42/17 |
| 2012/0122058 | A1 * | 5/2012 | Jensen | F41A 9/62 434/16 |
| 2012/0129136 | A1 * | 5/2012 | Dvorak | F41A 33/06 434/18 |

* cited by examiner

COVERS FOR NON-LETHAL GUN MAGAZINES

FIELD OF THE INVENTION

The field of the present invention relates to accessories for non-lethal weapons. More particularly, the field of the present invention relates to covers for non-lethal gun magazines.

BACKGROUND OF THE INVENTION

Non-lethal weapons are designed and intended to be less likely to kill a living target than conventional weapons, such as knives and firearms with traditional ammunition. Such non-lethal weapons are frequently used in policing and self-defense, when the use of lethal force is prohibited or undesirable. Non-lethal firearms (guns) are a frequently deployed type of non-lethal weapon. Such firearms are designed to shoot and inflict blunt force trauma using rubber bullets, soft polymer rounds, wax bullets, plastic bullets, beanbag rounds, and other forms of non-lethal ammunition. In some cases, such forms of non-lethal ammunition will also hold (and deploy upon impact) pepper sprays and other irritable gasses and substances. Non-lethal firearms often rely upon compressed gas cartridges, such as cartridges/cylinders that hold and deploy compressed carbon dioxide ($CO_2$). The compressed gas, when released, provides the necessary kinetic energy to cause the non-lethal ammunition to travel from the weapon and strike the intended target.

Non-lethal firearms are typically used in connection with gun magazines that are designed to hold a series of non-lethal rounds/bullets. In some cases, owners and operators of such non-lethal firearms will carry extra magazines and compressed gas cartridges. When such gun magazines are not engaged within a non-lethal firearm, there is some risk that the non-lethal ammunition will fall out of the magazine. Likewise, spare compressed gas cartridges may become lost or difficult to locate when needed (or, even worse, accidentally punctured).

Accordingly, there is a continuing need for devices that can be used to safely and conveniently hold and transport non-lethal gun magazines and spare compressed gas cartridges. As the following will demonstrate, the invention described herein addresses such demands in the marketplace (as well as others).

SUMMARY OF THE INVENTION

According to certain aspects of the present invention, covers for non-lethal gun magazines are disclosed. In certain embodiments, the covers include an external shell that has a top side, a bottom side, a wall that connects the top side and the bottom side, and an inner chamber. The covers preferably include a first opening located on the top side of the external shell, which is configured to receive the top portion of a non-lethal gun magazine, with the inner chamber being configured to fittingly hold the non-lethal gun magazine therein. The cover further includes a recessed area within the inner chamber that is configured to receive and fittingly hold a compressed gas cartridge. In addition, the cover includes a second opening within the wall that connects the top side and the bottom side, with the second opening being contiguous with the recessed area (or portion thereof) and is configured to enable manual contact with the compressed gas cartridge (when such compressed gas cartridge is held within the recessed area).

According to additional aspects of the present invention, non-lethal gun assemblies are provided. Such gun assemblies generally include non-lethal gun magazines and the covers for such non-lethal gun magazines, as described herein. In addition, such assemblies may further include the non-lethal gun itself, along with at least one gun magazine and associated cover.

The above-mentioned and additional features of the present invention are further illustrated in the Detailed Description contained herein.

DETAILED DESCRIPTION OF THE INVENTION

Figure 1:
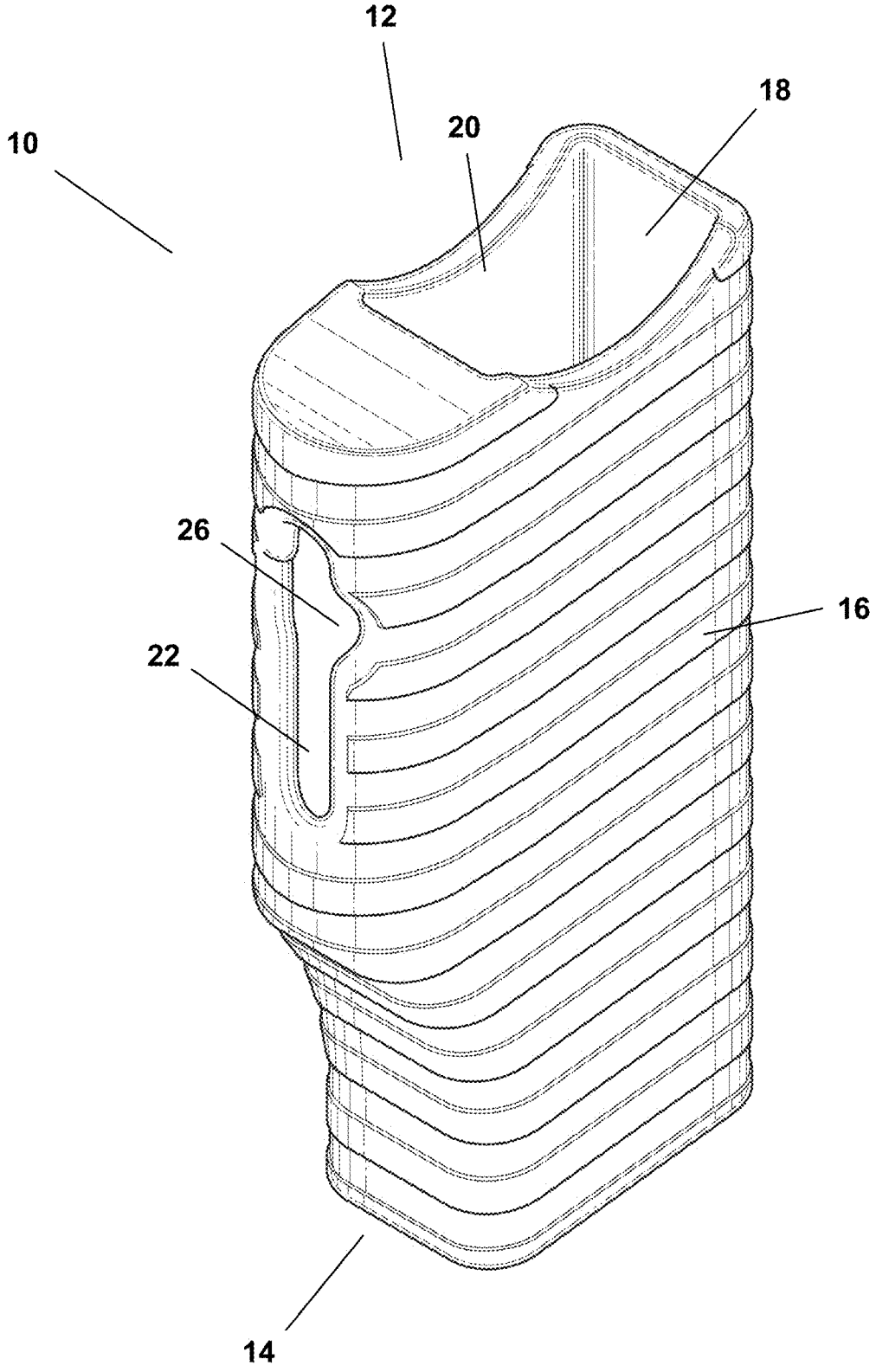
FIG. 1 is a perspective elevated view of a non-limiting example of a cover for a non-lethal gun magazine described herein.
Figure 2:
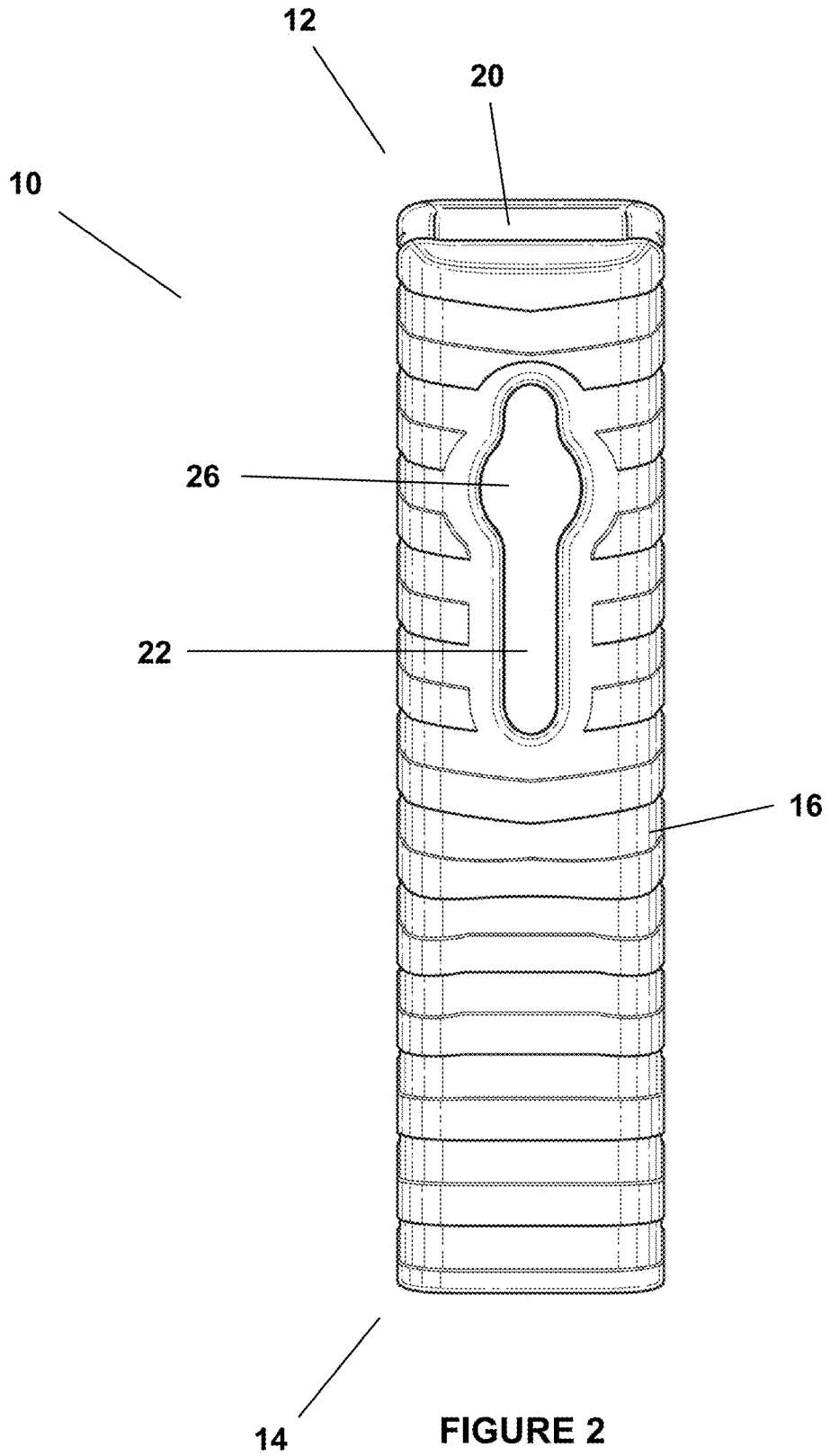
FIG. 2 is a front view of the magazine cover of FIG. 1.
Figure 3:
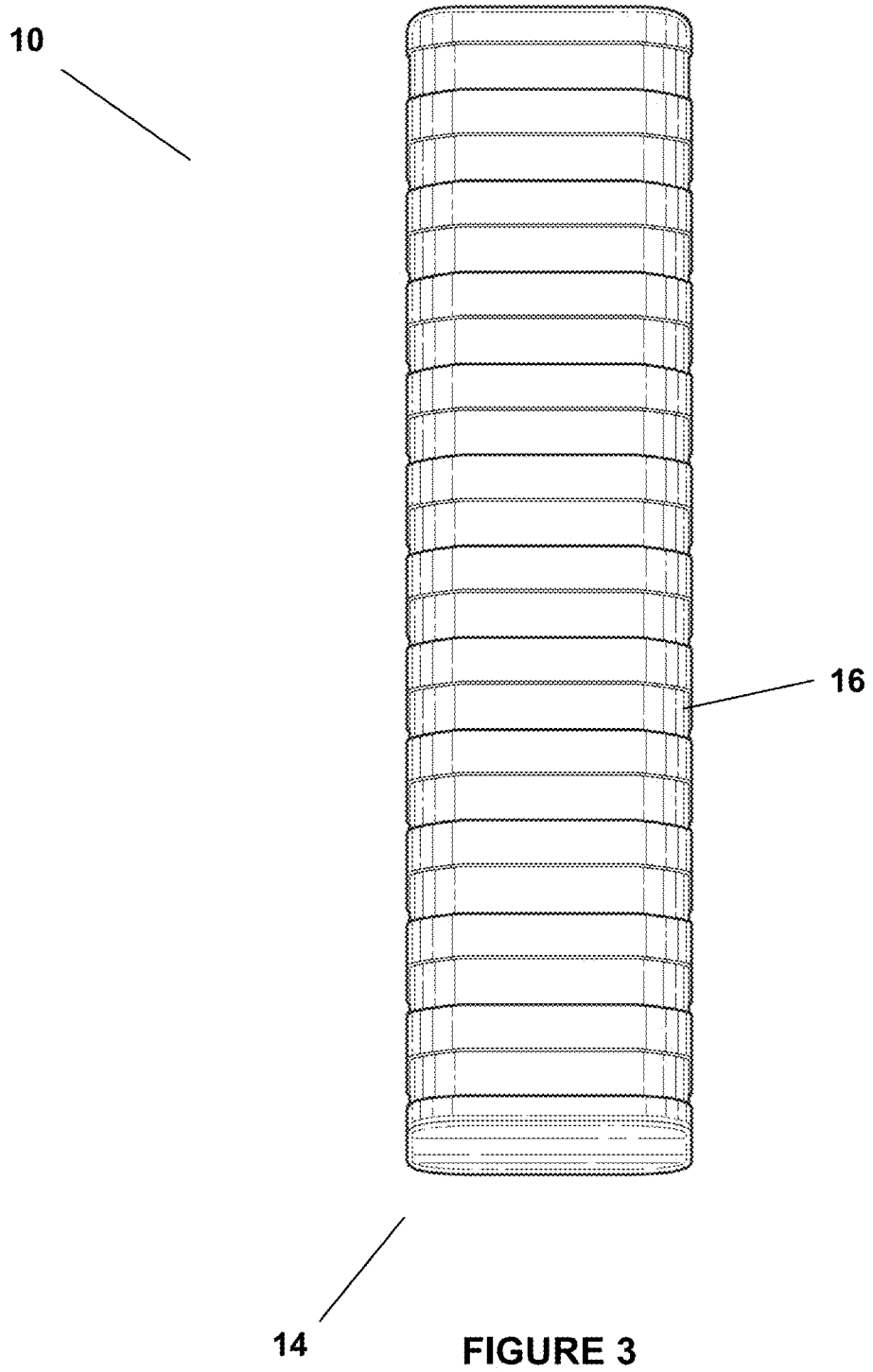
FIG. 3 is a back view of the magazine cover of FIG. 1.
Figure 4:
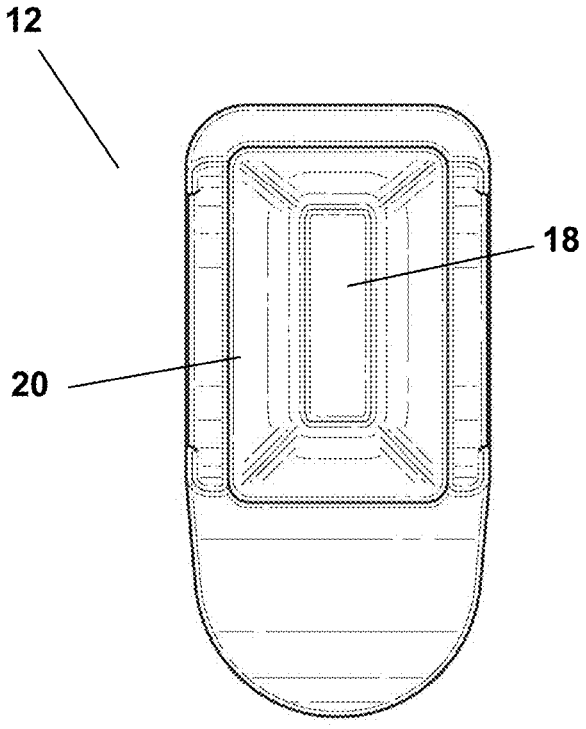
FIG. 4 is a top side view of the magazine cover of FIG. 1.
Figure 5:
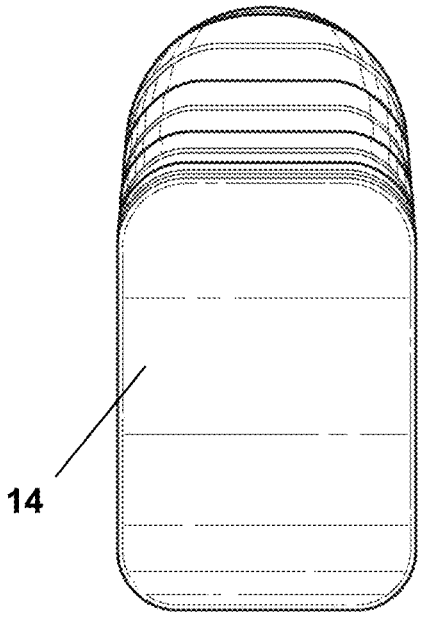
FIG. 5 is a bottom side view of the magazine cover of FIG. 1.
Figure 6:
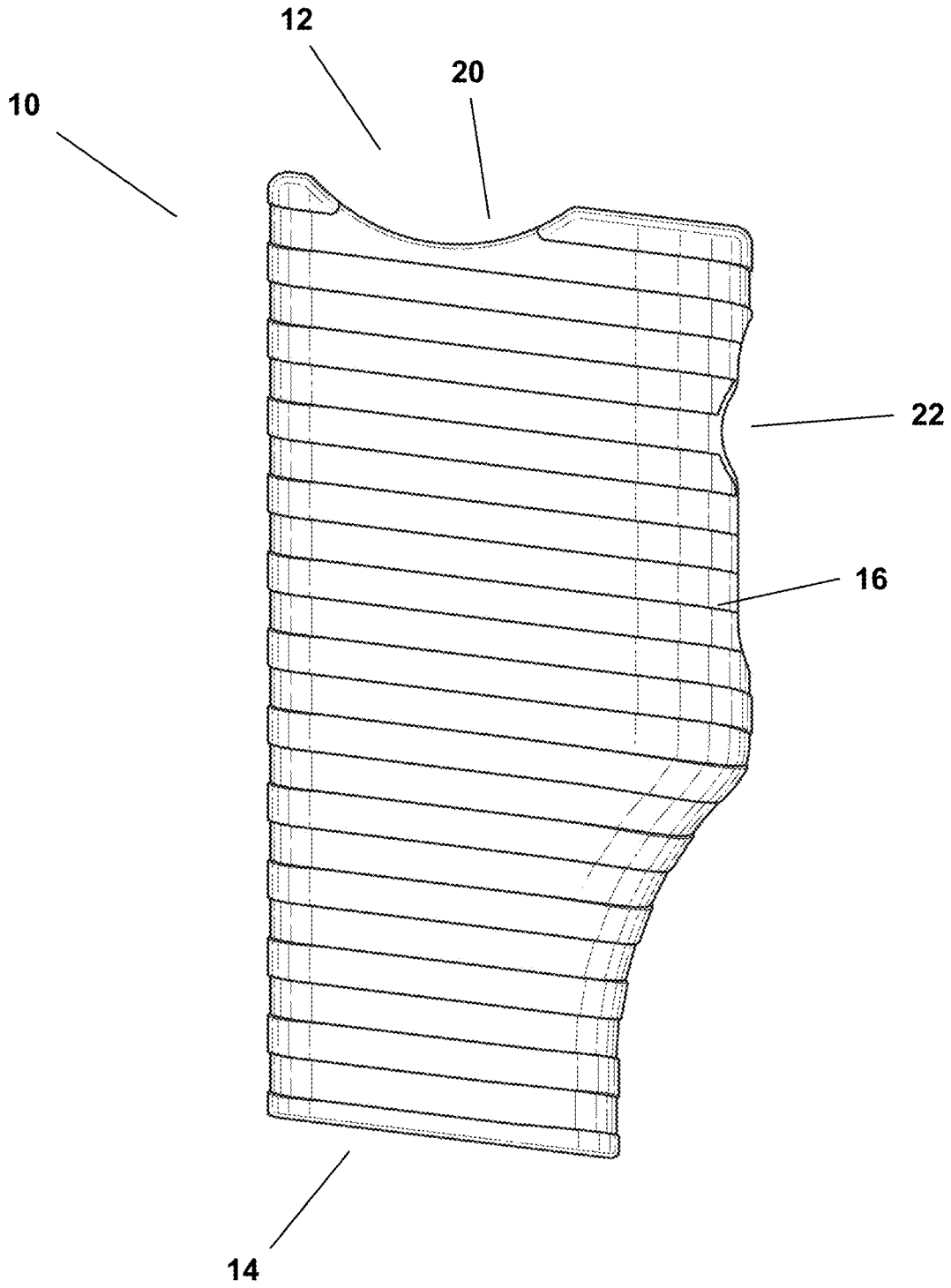
FIG. 6 is a left-side view of the magazine cover of FIG. 1.
Figure 7:
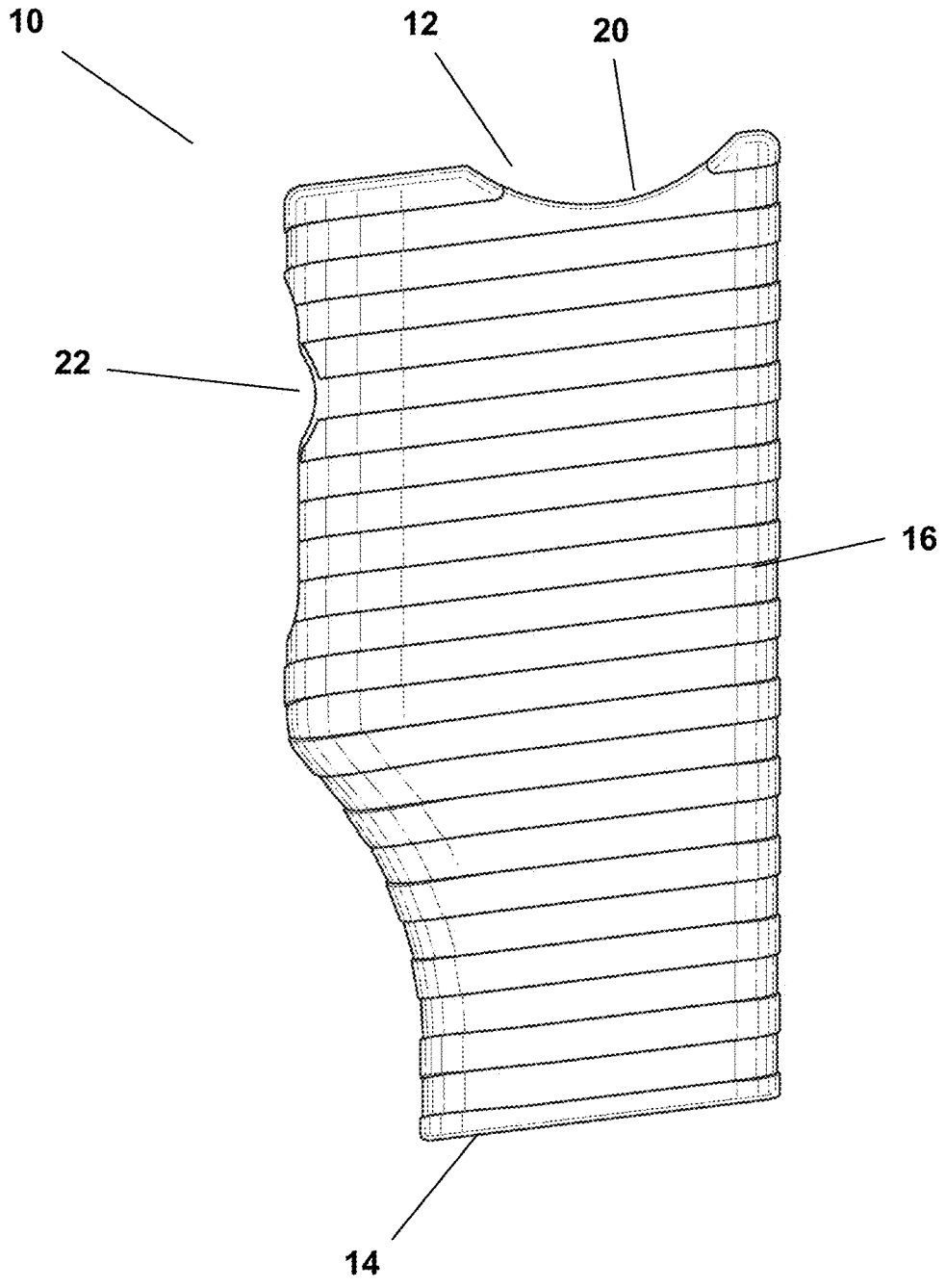
FIG. 7 is a right-side view of the magazine cover of FIG. 1.
Figure 8:
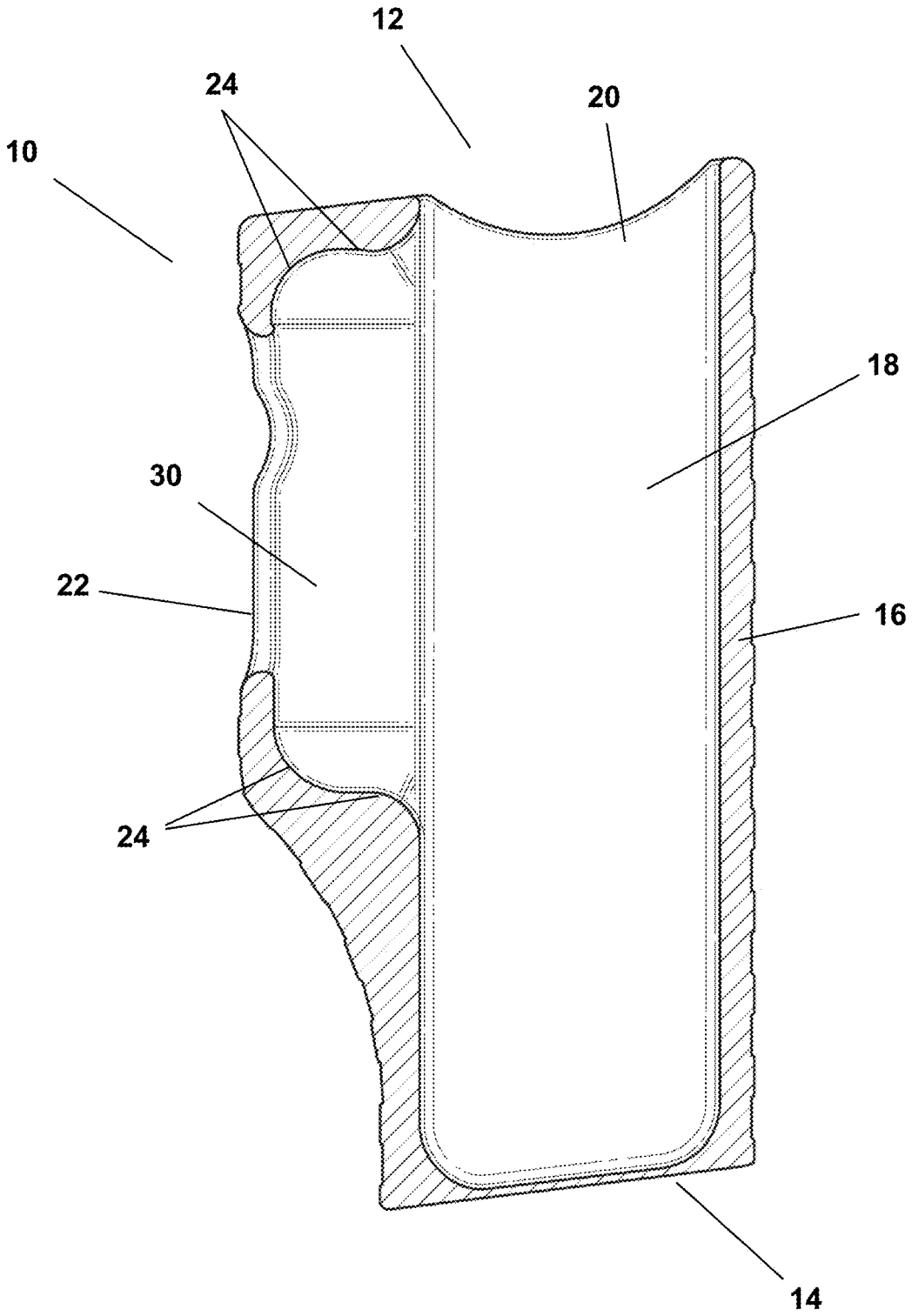
FIG. 8 is a right-side cross-sectional view of the magazine cover of FIG. 1.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

Referring now to FIGS. 1-9, according to certain preferred embodiments of the present invention, covers for non-lethal gun magazines are provided. In such preferred embodiments, the covers include an external shell 10 that has a top side 12, a bottom side 14, a wall 16 that connects the top side 12 and the bottom side 14, and an inner chamber 18. The covers preferably include a first opening 20 located on the top side 12 of the external shell 10, which is configured to receive the top portion of a non-lethal gun magazine, with the inner chamber 18 being configured to fittingly hold the non-lethal gun magazine. In other words, the invention provides that the non-lethal gun magazine may be inserted through the first opening 20 and pushed into the inner chamber 18, until the cover fully (or substantially) surrounds the non-lethal gun magazine. According to such preferred embodiments, the invention provides that the bottom side 14 of the cover is preferably configured to reside adjacent to a top portion of the non-lethal gun magazine when the non-lethal gun magazine is fully pushed into and held within the inner chamber 18.

According to certain preferred embodiments, the invention provides that the cover further includes a recessed area 30 (FIG. 8) within the inner chamber 18 that is configured to receive and fittingly hold a compressed gas cartridge. As used herein, the term "fittingly" means, e.g., that the dimensions of the recessed area 30 are configured to surround and hold a compressed gas cartridge (similar to a hand-and-glove relationship). Likewise, the term "fittingly" means, e.g., that the dimensions of the inner chamber 18 are configured to surround and hold a non-lethal gun magazine when inserted therein (again, similar to a hand-and-glove relationship).

Figure 9A:
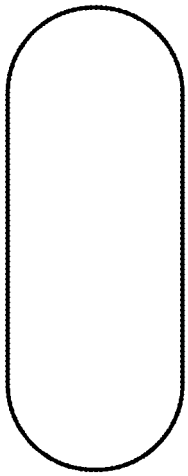
FIG. 9A is a cross-sectional view of a cylindrically-shaped compressed gas cartridge.
Figure 9B:
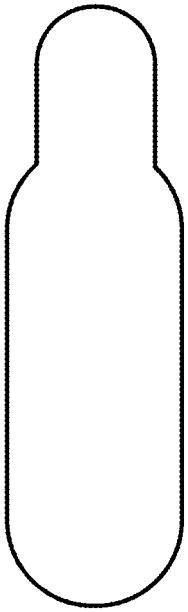
FIG. 9B is a cross-sectional view of an irregularly-shaped compressed gas cartridge.

According to such preferred embodiments, the invention provides that the cover includes a second opening 22 within the wall 16 that connects the top side 12 and the bottom side 14. The invention provides that the second opening 22 is preferably contiguous with the recessed area 30 and is configured to enable manual contact with the compressed gas cartridge (when such compressed gas cartridge is held within the recessed area 30). In certain preferred embodiments, the invention provides that the recessed area 30 exhibits a perimeter 24 (FIG. 8) that follows a contour of at least a portion of the compressed gas cartridge (e.g., the top and bottom areas of the compressed gas cartridge). More particularly, the invention provides that the perimeter 24 of the recessed area 30 preferably exhibits a dimension that enables the compressed gas cartridge to be manually inserted and pressed (snapped) into the recessed area 30 and retained therein. The invention provides that the perimeter 24 of the recessed area 30 may exhibit any dimension that accommodates the outer perimeter and contours of the compressed gas cartridge—and allows such compressed gas cartridge to be pressed into and mechanically held within the recessed area 30. For example, referring to FIG. 9, some compressed gas cartridges may exhibit cylindrical shapes (FIG. 9A); whereas, other compressed gas cartridges may exhibit irregular shapes (FIG. 9B). In either case, the invention provides that the recessed area 30 exhibits a perimeter 24 (FIG. 8) that follows a contour of at least a portion of such compressed gas cartridge, and is dimensioned to allow the compressed gas cartridge to be pressed (snapped) into and held within the recessed area 30.

In addition, the perimeter 24 of the recessed area 30 exhibits a dimension that enables the compressed gas cartridge to be manually dislodged from the recessed area 30 through manual contact with the compressed gas cartridge through the second opening 22. For example, in order to manually dislodge the compressed gas cartridge, the non-lethal gun magazine must first be removed from the cover (inner chamber 18), and then a person may press and push the compressed gas cartridge out of the recessed area 30 (such pressing force may be applied through the second opening 22). In certain preferred embodiments, the second opening 22 exhibits an enlarged area 26 that is configured to facilitate such contact between a person's finger and the compressed gas cartridge. More specifically, for example, the enlarged area 26 may exhibit a width that is greater than the corresponding width of the remaining areas of the second opening 22. The invention further provides that the external shell 10 may, optionally, include a belt clip or an element for mechanically attaching the cover to a belt clip (such as screw holes, snaps, magnets, or other means for attaching the external shell 10 to a belt clip).

According to yet further embodiments of the present invention, non-lethal gun assemblies are provided, which generally include non-lethal gun magazines and the covers for such non-lethal gun magazines, as described herein. In other words, the invention provides that the non-lethal gun magazine covers of the present invention may be offered and sold separately or, in other embodiments, the non-lethal gun magazine covers of the present invention may be offered and sold along with non-lethal gun magazines. Still further, the invention provides that, in some embodiments, such covers may be offered and sold along with non-lethal gun magazines and non-lethal firearms.

The invention provides many advantages over existing non-lethal gun magazines and related accessories. For example, the covers of the present invention are designed to lock a spare compressed gas cartridge in place, which has nowhere to move when retained within the recessed area 30 and further adjacent to a non-lethal gun magazine being held within the inner chamber 18 described herein. The invention further provides that the covers disclosed herein are configured to prevent inadvertent unlocking and spillage of non-lethal ammunition from the gun magazines (and also prevent inadvertent puncturing of such non-lethal ammunition and spare compressed gas cartridges).

The invention provides that the non-lethal gun magazine covers of the present invention may be manufactured from and comprised of any suitably rigid materials. For example, the non-lethal gun magazine covers of the present invention may be manufactured from and comprised of plastics, elastomers, metals, alloys, and combinations of such materials.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

We claim:

1. A cover for a non-lethal gun magazine, which comprises:

(a) an external shell that includes a top side, a bottom side, a wall that connects the top side and the bottom side, and an inner chamber;

(b) a first opening located on the top side of the external shell, wherein the first opening is configured to receive a non-lethal gun magazine and the inner chamber is configured to fittingly hold the non-lethal gun magazine;

(c) a recessed area within the inner chamber that is configured to receive and hold a compressed gas cartridge; and (d) a second opening within the wall that connects the top side and the bottom side, wherein the second opening is contiguous with the recessed area within the inner chamber and is configured to enable manual contact with the compressed gas cartridge when such compressed gas cartridge is held within the recessed area.

2. The cover for a non-lethal gun magazine of claim 1, wherein the bottom side is configured to reside adjacent to a top portion of the non-lethal gun magazine when the non-lethal gun magazine is held within the inner chamber.

3. The cover for a non-lethal gun magazine of claim 2, wherein the recessed area exhibits a perimeter that follows a contour of at least a portion of the compressed gas cartridge.

4. The cover for a non-lethal gun magazine of claim 3, wherein the perimeter of the recessed area exhibits a dimension that (a) enables the compressed gas cartridge to be manually inserted and pressed into the recessed area and retained therein and (b) enables the compressed gas cartridge to be manually dislodged from the recessed area through manual contact with the compressed gas cartridge through the second opening.

5. The cover for a non-lethal gun magazine of claim 4, wherein the second opening exhibits an enlarged area that is configured to facilitate contact between a person's finger and the compressed gas cartridge.

6. The cover for a non-lethal gun magazine of claim 1, which further includes a belt clip or an element for mechanically attaching the cover to a belt clip.

7. A non-lethal gun assembly, which includes a non-lethal gun magazine and a cover for said non-lethal gun magazine, wherein the cover comprises:

(a) an external shell that includes a top side, a bottom side, a wall that connects the top side and the bottom side, and an inner chamber;

(b) a first opening located on the top side of the external shell, wherein the first opening is configured to receive the non-lethal gun magazine and the inner chamber is configured to fittingly hold the non-lethal gun magazine;

(c) a recessed area within the inner chamber that is configured to receive and hold a compressed gas cartridge; and (d) a second opening within the wall that connects the top side and the bottom side, wherein the second opening is contiguous with the recessed area within the inner chamber and is configured to enable manual contact with the compressed gas cartridge when such compressed gas cartridge is held within the recessed area.

8. The non-lethal gun assembly of claim 7, wherein the bottom side is configured to reside adjacent to a top portion of the non-lethal gun magazine when the non-lethal gun magazine is held within the inner chamber.

9. The non-lethal gun assembly of claim 8, wherein the recessed area exhibits a perimeter that follows a contour of at least a portion of the compressed gas cartridge.

10. The non-lethal gun assembly of claim 9, wherein the perimeter of the recessed area exhibits a dimension that (a) enables the compressed gas cartridge to be manually inserted and pressed into the recessed area and retained therein and (b) enables the compressed gas cartridge to be manually dislodged from the recessed area through manual contact with the compressed gas cartridge through the second opening.

11. The non-lethal gun assembly of claim 10, wherein the second opening exhibits an enlarged area that is configured to facilitate contact between a person's finger and the compressed gas cartridge.

12. The non-lethal gun assembly of claim 7, which further includes a belt clip or an element for mechanically attaching the cover to a belt clip.

13. The non-lethal gun assembly of claim 7, which further includes a non-lethal firearm.

* * * * *